US006203961B1

(12) United States Patent
Pan et al.

(10) Patent No.: US 6,203,961 B1
(45) Date of Patent: Mar. 20, 2001

(54) DEVELOPER COMPOSITIONS AND PROCESSES

(75) Inventors: David H. Pan, Rochester, NY (US); Guerino G. Sacripante, Oakville (CA)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/603,890

(22) Filed: Jun. 26, 2000

(51) Int. Cl.[7] ..... G03G 9/13
(52) U.S. Cl. ..... 430/114
(58) Field of Search ..... 430/114

(56) References Cited

U.S. PATENT DOCUMENTS

| | | | |
|---|---|---|---|
| H1483 | 9/1995 | Larson et al. | 430/115 |
| 4,707,429 | 11/1987 | Trout | 430/115 |
| 5,019,477 | 5/1991 | Felder | 430/115 |
| 5,028,508 | 7/1991 | Lane et al. | 430/115 |
| 5,030,535 | 7/1991 | Drappel et al. | 430/116 |
| 5,034,299 | 7/1991 | Houle et al. | 430/115 |
| 5,045,425 | 9/1991 | Swidler | 430/115 |
| 5,066,821 | 11/1991 | Houle et al. | 430/137 |
| 5,069,995 | 12/1991 | Swidler | 430/115 |
| 5,278,020 | 1/1994 | Grushkin et al. | 430/137 |
| 5,290,654 | 3/1994 | Sacripante et al. | 430/137 |
| 5,306,591 | 4/1994 | Larson et al. | 430/115 |
| 5,308,731 | 5/1994 | Larson et al. | 430/115 |
| 5,308,734 | 5/1994 | Sacripante et al. | 430/137 |
| 5,344,738 | 9/1994 | Kmiecik-Lawrynowicz et al. | 430/137 |
| 5,346,797 | 9/1994 | Kmiecik-Lawrynowicz et al. | 430/137 |
| 5,348,832 | 9/1994 | Sacripante et al. | 430/109 |
| 5,364,729 | 11/1994 | Kmiecik-Lawrynowicz et al. | 430/137 |
| 5,366,841 | 11/1994 | Patel et al. | 430/137 |
| 5,370,963 | 12/1994 | Patel et al. | 430/137 |
| 5,403,693 | 4/1995 | Patel et al. | 430/137 |
| 5,405,728 | 4/1995 | Hopper et al. | 430/137 |
| 5,418,108 | 5/1995 | Kmiecik-Lawrynowicz et al. | 430/137 |
| 5,496,676 | 3/1996 | Croucher et al. | 430/137 |
| 5,501,935 | 3/1996 | Patel et al. | 430/137 |
| 5,527,658 | 6/1996 | Hopper et al. | 430/137 |
| 5,585,215 | 12/1996 | Ong et al. | 430/107 |
| 5,593,807 | 1/1997 | Sacripante et al. | 430/137 |
| 5,627,002 | 5/1997 | Pan et al. | 430/115 |
| 5,650,255 | 7/1997 | Ng et al. | 430/137 |
| 5,650,256 | 7/1997 | Veregin et al. | 430/137 |
| 5,660,965 | 8/1997 | Mychajlowskij et al. | 430/137 |
| 5,672,456 | 9/1997 | Chamberlain et al. | 430/115 |
| 5,684,063 * | 11/1997 | Patel et al. | 430/114 |
| 5,826,147 | 10/1998 | Liu et al. | 399/237 |
| 5,840,462 | 11/1998 | Foucher et al. | 430/137 |
| 5,853,944 | 12/1998 | Foucher et al. | 430/137 |
| 5,869,215 | 2/1999 | Ong et al. | 430/137 |
| 5,869,216 | 2/1999 | Ong et al. | 430/137 |
| 5,910,387 | 6/1999 | Mychajlowskij et al. | 430/110 |
| 5,919,595 | 7/1999 | Mychajlowskij et al. | 430/137 |
| 5,945,245 | 8/1999 | Mychajlowskij et al. | 430/137 |

OTHER PUBLICATIONS

Grant & Hackh's Chemical Dictionary, p 304, 1987.*

* cited by examiner

*Primary Examiner*—Roland Martin
(74) *Attorney, Agent, or Firm*—E. O. Palazzo

(57) ABSTRACT

A reverse charging printing liquid developer comprised of a nonpolar liquid, and dispersed therein a toner comprised of a sulfonated polyester resin and a colorant.

26 Claims, No Drawings

DEVELOPER COMPOSITIONS AND PROCESSES

COPENDING APPLICATIONS AND PATENTS

Illustrated in application U.S. Ser. No. 09/492,707, pending U.S. Ser. No. 09/492,706, pending U.S. Ser. No. 09/492,715 pending and U.S. Ser. No. 09/492,429, pending the disclosures of each application being totally incorporated herein by reference, are developers with charge acceptance components and imaging processes thereof. The developers of the present invention can be selected for the imaging processes and apparatus of the copending application, such as copending application U.S. Ser. No. 09/492,715.

Illustrated U.S. Pat. No. 5,627,002, the disclosure of which is totally incorporated herein by reference, is a positively charged liquid developer comprised of a nonpolar liquid, thermoplastic resin particles, pigment, a charge director, and a charge control agent comprised of a cyclodextrin or a cyclodextrin derivative containing one or more organic basic amino groups.

Disclosed in U.S. Pat. No. 5,826,147, the disclosure of which is totally incorporated herein by reference, is an electrostatic latent image development process wherein there is selected an imaging member with an imaging surface containing a layer of marking material and wherein image-wise charging can be accomplished with a wide beam ion source such that free mobile ions are introduced in the vicinity of an electrostatic image associated with the imaging member.

The disclosures of each of the following patents are totally incorporated herein by reference.

U.S. Pat. No. 5,840,462 discloses a toner process wherein a colorant is flushed into a sulfonated polyester, followed by the addition of an organic soluble dye and an alkali halide solution.

U.S. Pat. No. 5,853,944 discloses a toner process with a first aggregation of sulfonated polyester, and thereafter, a second aggregation with a colorant dispersion and an alkali halide.

U.S. Pat. No. 5,945,245 discloses a toner process wherein a latex emulsion and a colorant dispersion are mixed in the presence of an organic complexing agent or compound, and wherein the latex can contain a sodio sulfonated polyester resin.

U.S. Pat. No. 5,910,387 discloses an emulsion/aggregation/fusing process for the preparation of a toner containing a resin derived from the polymerization of styrene butadiene, acrylonitrile, and acrylic acid.

U.S. Pat. No. 5,919,595 discloses a toner process wherein there is mixed an emulsion latex, and which latex may contain a sulfonated polyester, a colorant dispersion, and a monocationic salt, and wherein the resulting mixture possesses an ionic strength of about 0.001 molar to about 5 molar.

U.S. Pat. No. 5,869,215 discloses a toner process by blending an aqueous colorant dispersion with a latex blend containing a linear polymer and soft crosslinked polymer particles.

U.S. Pat. No. 5,869,216 discloses a toner process wherein there is mixed an aqueous colorant dispersion and an emulsion latex, and which latex may contain a sulfonated polyester, followed by filtering, and redispersing the toner formed in water at a pH of above about 7 and contacting the resulting mixture with a metal halide or salt and then with a mixture of an alkaline base and a salicylic acid, a catechol, or mixtures thereof.

Illustrated in U.S. Pat. No. 5,593,807, the disclosure of which is totally incorporated herein by reference, is a process for the preparation of toner compositions comprising, for example, preparing an emulsion latex comprised of sodio sulfonated polyester resin particles of about 5 to about 500 nanometers in size diameter by heating the resin in water at a temperature of, for example, from about 65° C. to about 90° C.; preparing a colorant dispersion by dispersing in water from about 10 to about 25 weight percent of a sodio sulfonated polyester and from about 1 to about 5 weight percent of colorant; adding with shearing the colorant dispersion to the latex mixture, followed by the addition of an alkali metal halide, such as calcium chloride until aggregation results as indicated, for example, by an increase in the latex viscosity of from about 2 centipoise to about 100 centipoise; heating the resulting mixture at a temperature of from about 45° C. to about 80° C. thereby causing further aggregation and enabling coalescence, resulting in toner particles of from about 4 to about 9 microns in volume average diameter and with a geometric distribution of less than about 1.3; and optionally cooling the product mixture to about 25° C., followed by washing and drying.

Also of possible interest is U.S. Pat. No. 5,660,965, the disclosures of which is totally incorporated herein by reference.

The appropriate components and processes of the above copending applications, such as the sulfonated polyesters, may be selected for the invention of the present application in embodiments thereof.

BACKGROUND OF THE INVENTION

This invention is generally directed to liquid developer compositions and processes thereof, and wherein there can be generated improved developed images thereof in bipolar ion charging processes, and reverse charge imaging and printing development (RCP) processes, reference U.S. Pat. No. 5,826,147, the disclosure of which is totally incorporated herein by reference, and wherein the developer contains no charge director, or wherein the developer contains substantially no charge director. The liquid developer of the present invention may be clear in color and is comprised of a sulfonated polyester toner dispersed in a nonpolar solvent and wherein the polyester can be prepared by emulsion/aggregation processes as illustrated herein, and more specifically, as illustrated in the appropriate patents and patent applications recited herein and wherein the developer captures both positive and negative charges.

The present invention is also specifically directed to a electrostatographic imaging process, such as RCP processes, wherein an electrostatic latent image bearing member containing a layer of marking material, toner particles, or liquid developer as illustrated herein and containing a toner comprised of a polyester resin, colorant, and optional additives dispersed in a nonpolar liquid, such as a hydrocarbon fluid, is selectively charged in an imagewise manner to create a secondary latent image corresponding to the electrostatic latent image on the imaging member. Imagewise charging can be accomplished by a wide beam charge source for introducing free mobile charges or ions in the vicinity of the electrostatic latent image coated with the layer of marking material or toner particles. The latent image causes the free mobile charges or ions to flow in an imagewise ion stream corresponding to the latent image. These charges or ions, in turn, are accepted by the marking material or toner particles, leading to imagewise charging of the marking material or toner particles with the layer of marking material or toner particles itself becoming the latent image carrier. The latent image carrying toner layer is subsequently developed by selectively separating and transferring image areas of the toner layer to a copy substrate for producing an output document.

Moreover, the present invention relates to an imaging apparatus, wherein an electrostatic latent image including image and non-image areas is formed in a layer of marking material, and further wherein the latent image can be developed by selectively separating portions of the latent image bearing layer of the marking material such that the image areas reside on a first surface and the non-image areas reside on a second surface. In a simple embodiment, the invention relates to an image development apparatus, comprising a system for generating a first electrostatic latent image on an imaging member, wherein the electrostatic latent image includes image and non-image areas having distinguishable charge potentials, and a system for generating a second electrostatic latent image on a layer of marking materials situated adjacent the first electrostatic latent image on the imaging member, wherein the second electrostatic latent image includes image and non-image areas having distinguishable charge potentials of a polarity opposite to the charge potentials of the charged image and non-image areas in the first electrostatic latent image.

The liquid developers and processes of the present invention possess a number of advantages in embodiments including the development and generation of images with improved image quality, the avoidance of a charge director, the enablement of the developers in a reverse charging development process, excellent image transfer, and the avoidance of complex chemical charging of the developer. Poor transfer can, for example, result in poor solid area coverage if insufficient toner is transferred to the final substrate and can also cause image defects such as smears and hollowed fine features. Conversely, overcharging the toner particles can result in low reflective optical density images or poor color richness or chroma since only a few very highly charged particles can discharge all the charge on the dielectric receptor causing too little toner to be deposited. To overcome or minimize such problems, the liquid toners, or developers and processes of the present invention were arrived at after extensive research. Other advantages are as illustrated herein and also include minimal or no image blooming, the generation of excellent solid area images, minimal or no developed image character defects, excellent resin impaction, thus permitting, for example, simplified image conditioning, excellent positive and negative toner ion charging, and the like.

PRIOR ART

A latent electrostatic image can be developed with toner particles dispersed in an insulating nonpolar liquid. These dispersed materials are known as liquid toners or liquid developers. The latent electrostatic image may be generated by providing a photoconductive imaging member or layer with a uniform electrostatic charge, and developing the image with a liquid developer, or colored toner particles dispersed in a nonpolar liquid which generally has a high volume resistivity in excess of $10^9$ ohm-centimeters, a low dielectric constant, for example below about 3, and a moderate vapor pressure. Generally, the toner particles are less than about 30 $\mu$m (microns) average by area size as measured with the Malvem 3600E-particle sizer.

U.S. Pat. No. 5,019,477, the disclosure of which is totally incorporated herein by reference, discloses a liquid electrostatic developer comprising a nonpolar liquid, thermoplastic resin particles, and a charge director. The ionic or zwitterionic charge directors illustrated may include both negative charge directors, such as lecithin, oil-soluble petroleum sulfonates and alkyl succinimide, and positive charge directors such as cobalt and iron naphthanates. The thermoplastic resin particles can comprise a mixture of (1) a polyethylene homopolymer or a copolymer of (i) polyethylene and (ii) acrylic acid, methacrylic acid or alkyl esters thereof, wherein (ii) comprises 0.1 to 20 weight percent of the copolymer; and (2) a random copolymer (iii) of vinyl toluene and styrene and (iv) butadiene and acrylate. As the copolymer with polyethylene and methacrylic acid or methacrylic acid, alkyl esters, NUCREL® may be selected.

U.S. Pat. No. 5,030,535, the disclosure of which is totally incorporated herein by reference, discloses a liquid developer composition comprising a liquid vehicle, a charge additive and toner pigmented particles. The toner particles may contain pigment particles and a resin selected from the group consisting of polyolefins, halogenated polyolefins and mixtures thereof. The liquid developers can be prepared by first dissolving the polymer resin in a liquid vehicle by heating at temperatures of from about 80° C. to about 120° C., adding pigment to the hot polymer solution and attriting the mixture, and then cooling the mixture whereby the polymer becomes insoluble in the liquid vehicle, thus forming an insoluble resin layer around the pigment particles.

Moreover, in U.S. Pat. No. 4,707,429, the disclosure of which is totally incorporated herein by reference, there are illustrated, for example, liquid developers with an aluminum stearate charge adjuvant. Liquid developers with charge directors are also illustrated in U.S. Pat. 5,045,425. Also, stain elimination in consecutive colored liquid toners is illustrated in U.S. Pat. No. 5,069,995. Further, of interest with respect to liquid developers are U.S. Pat. Nos. 5,034,299; 5,066,821 and 5,028,508, the disclosures of which are totally incorporated herein by reference.

Illustrated in U.S. Pat. No. 5,306,591, the disclosure of which is totally incorporated herein by reference, is a liquid developer comprised of a liquid component, thermoplastic resin; an ionic or zwitterionic charge director, or directors soluble in a nonpolar liquid; and a charge additive, or charge adjuvant comprised of an imine bisquinone; in U.S. Statutory Invention Registration No. H1483 there is described a liquid developer comprised of thermoplastic resin particles, and a charge director comprised of an ammonium AB diblock copolymer, and in U.S. Pat. No. 5,307,731 there is disclosed a liquid developer comprised of a liquid, thermoplastic resin particles, a nonpolar liquid soluble charge director, and a charge adjuvant comprised of a metal hydroxycarboxylic acid, the disclosures of each of these patents, and the Statutory Registration being totally incorporated herein by reference.

Emulsion/aggregated toners and processes thereof are illustrated in U.S. patents the disclosures of which are totally incorporated herein by reference, such as U.S. Pat. No. 5,290,654, U.S. Pat. No. 5,278,020, U.S. Pat. No. 5,308,734, U.S. Pat. No. 5,370,963, U.S. Pat. No. 5,344,738, U.S. Pat. No. 5,403,693, U.S. Pat. No. 5,418,108, U.S. Pat. No. 5,364,729, and U.S. Pat. No. 5,346,797; and also of interest may be U.S. Pat. No. 5,348,832; 5,405,728; 5,366,841; 5,496,676; 5,527,658; 5,585,215; 5,650,255; 5,650,256 and 5,501,935.

SUMMARY OF THE INVENTION

Examples of features of the present invention include:

It is a feature of the present invention to provide a liquid developer with many of the advantages illustrated herein.

Another feature of the present invention resides in the provision of a liquid developer capable of modulated particle charging with, for example, corona ions for image quality optimization, and liquid developers wherein image conditioning can be improved.

It is a further feature of the invention to provide positively charged, and/or negatively charged liquid developers wherein there are selected an emulsion/aggregated/coalesced toner comprised of a sulfonated polyester, and a colorant dispersed in a liquid.

It is still a further feature of the invention to provide positively and negatively charged liquid developers wherein developed image defects, such as smearing, loss of resolution and loss of density, and color shifts in prints having magenta images overlaid with yellow images are eliminated or minimized.

Also, in another feature of the present invention there are provided positively charged liquid developers that are in embodiments superior to liquid developers with no charge director in that they can be selected for RCP (reverse charge printing) development, reference U.S. Pat. No. 5,826,147, the disclosure of which is totally incorporated herein by reference, and wherein there can be generated high quality images, and wherein charging can be accomplished by bipolar ion charging (BIC).

Furthermore, in another feature of the present invention there are provided liquid toners that enable excellent image characteristics, and which toners enhance the positive charge of the toner resin selected; and wherein substantially uncharged toner particles are suspended in a nonpolar liquid.

These and other features of the present invention can be accomplished in embodiments by the provision of liquid developers.

Aspects of the present invention relate to a reverse charging printing liquid developer comprised of a nonpolar liquid, and dispersed therein a toner comprised of a sulfonated polyester resin and a colorant; a liquid developer comprised of a nonpolar liquid, and dispersed therein a toner comprised of a sulfonated polyester resin and a colorant, and wherein the toner is generated by emulsion/aggregation/coalescence processes; a liquid developer wherein the liquid has a viscosity of from about 0.5 to about 500 centipoise and resistivity equal to or greater than $5\times10^9$, and the resin possesses a volume average particle diameter of from about 0.1 to about 30 microns; a liquid developer wherein the colorant is present in an amount of from about 0.1 to about 60 percent by weight based on the total weight of the toner components of resin and colorant; a liquid developer wherein the colorant is carbon black, cyan, magenta, yellow, blue, green, orange, red, violet and brown or mixtures thereof; a liquid developer wherein the liquid is present in an amount of from about 75 to about 97 weight percent, the toner contains a sulfonated polyester in an amount of from about 40 to about 100 weight percent and from about zero (0) to about 60 weight percent of colorant; a liquid developer wherein the liquid for the developer is an aliphatic hydrocarbon; a liquid developer wherein the aliphatic hydrocarbon is a mixture of branched hydrocarbons of from about 8 to about 16 carbon atoms, or a mixture of normal hydrocarbons of from about 8 to about 16 carbon atoms; a liquid developer wherein the aliphatic hydrocarbon is a mixture of branched hydrocarbons with from about 8 to about 16 carbon atoms; a liquid developer wherein the sulfonated polyester resin is prepared by heating the resin in water at a temperature of from about 65° C. to about 90° C.; (i) thereafter adding the colorant as a dispersion, wherein the colorant dispersion is stabilized by the sulfonated polyester, and wherein the sulfonated polyester is of a submicron diameter or size, adding to the latex mixture with shearing, followed by the addition of an amine and water until there results an increase in the latex viscosity of from about 2 centipoise to about 100 centipoise, cooling, and heating the resulting mixture at a temperature of from about 45° C. to about 80° C. thereby enabling continuous aggregation and coalescence of particles of resin and colorant, resulting in toner particles of from about 2 to about 20 microns in volume average diameter; a liquid developer wherein the colorant dispersion contains a pigment, and wherein the pigment is stabilized by the submicron sulfonated polyester, and which polyester is a sodio sulfonated polyester, and which resin is in the size range of from about 50 to about 250 nanometers, and wherein the shearing in (i) is completed by homogenizing at from about 1,000 revolutions per minute to about 10,000 revolutions per minute, at a temperature of from about 25° C. to about 35° C., and for a duration of from about 1 minute to about 120 minutes; a liquid developer wherein the dispersion of (i) is accomplished by microfluidization in a microfluidizer, or in nanojet for a duration of from about 1 minute to about 120 minutes; a liquid developer wherein shearing or homogenization is accomplished by homogenizing at from about 1,000 revolutions per minute to about 10,000 revolutions per minute for a duration of from about 1 minute to about 120 minutes; a liquid developer wherein the sulfonated polyester is a polyester of poly(1,2-propylene-sodio 5-sulfoisophthalate), poly(neopentylene-sodio 5-sulfoisophthalate), poly(diethylene-sodio 5-sulfoisophthalate), copoly(1,2-propylene-sodio 5-sulfoisophthalate)-copoly-(1,2-propylene-terephthalate-phthalate), copoly(1,2-propylene-diethylene sodio 5-sulfoisophthalate)-copoly-(1,2-propylene-diethylene-terephthalate-phthalate), copoly(ethylene-neopentylene-sodio 5-sulfoisophthalate)-copoly-(ethylene-neopentylene-terephthalate-phthalate), or copoly(propoxylated bisphenol A)-copoly-(propoxylated bisphenol A-sodio 5-sulfoisophthalate); a liquid developer wherein the polyester is poly(1,2-propylene-sodio 5-sulfoisophthalate), poly(neopentylene-sodio 5-sulfoisophthalate), poly(diethylene-sodio 5-sulfoisophthalate), copoly(1,2-propylene-sodio 5-sulfoisophthalate)-copoly-(1,2-propylene-terephthalate-phthalate), copoly(1,2-propylene-diethylene sodio 5-sulfoisophthalate)-copoly-(1,2-propylene-diethylene-terephthalate-phthalate), copoly(ethylene-neopentylene-sodio 5-sulfoisophthalate)-copoly-(ethylene-neopentylene-terephthalate-phthalate), or copoly(propoxylated bisphenol A)-copoly-(propoxylated bisphenol A-sodio 5-sulfoisophthalate); a liquid developer wherein the polyester utilized is from about 0.01 to about 0.2 micron in volume average diameter, and the colorant particles are from about 0.01 to about 500 nanometers in volume average diameter; and wherein the toner particles isolated are from about 2 to about 15 microns in volume average diameter, and the geometric size distribution thereof is from about 1.15 to about 1.35; a liquid developer wherein the toner obtained after cooling is from about 3 to about 15 microns in volume average diameter, and the geometric size distribution thereof is from about 1.15 to about 1.30; a process for the preparation of a developer comprising mixing an emulsion latex comprised of sulfonated polyester resin particles and a colorant dispersion, and optionally wherein the colorant is stabilized by submicron resin particles, optionally followed by the addition of an amine; and heating the resulting mixture thereby causing aggregation and coalescence; a liquid developer wherein subsequent to heating to accomplish coalescence the product mixture is cooled, followed by isolation, washing and drying; a liquid developer wherein the product mixture is cooled to about 25° C.; a reverse charge printing process utilizing the liquid developer of the present invention; a process wherein the developer is charged by bipolar ion charging; an imaging or printing apparatus containing the developer of the present invention; liquid developers comprised of a nonpolar liquid, a toner comprised of a colorant and sulfonated polyester resin, and which toner is dispersed in a liquid, such as a hydrocarbon fluid, like the ISOPARS, and wherein the toner captures both positive and negative charges on demand, and which developer can be selected for RCP processes. In embodiments, reverse charge printing (RCP) process, a corotron or a scorotron are usually the source of corona ions, and the positive or negative corona ions are the source of toner charging. The liquid toner particles capture positive or negative charges from positive or negative corona ion source, respectively. If the liquid developer layer captures and retains positive (or negative) charges, the surface voltage of the toner layer is positive (or negative), as can be detected or read by using electrostatic voltmeter. The resulting surface voltage is related to the Q/M of the toner particle as a result of corona ion charging.

In embodiments thereof of the present invention the liquid developers can be charged in a device which first charges the developer to a first polarity, such as a positive polarity, followed by a second charging with a second charging device to reverse the developer charge polarity, such as to a negative polarity in an imagewise manner. Subsequently, a biased image bearer (IB) separates the image from the background corresponding to the charged image pattern in the toner or developer layer. Thus, the liquid developers are preferably charged by bipolar ion charging (BIC) rather than with chemical charging.

With the present invention, there is initially generated toner by emulsion/aggregation/coalescence processes and which toner preferably contains a polyester resin and colorant, and wherein the toner, which is uncharged, is dispersed in a suitable liquid, and which toner is charged by bipolar ion charging (BIC), reference the appropriate copending applications recited herein, and wherein the resulting charged liquid developer can be selected for reverse charge printing processes, or RCP, reference the appropriate copending applications recited herein.

The polyester resin selected preferably contains sulfonated groups thereby rendering the polyester dissipatible, that is the polyester can form spontaneous emulsions in water without the use of organic solvents, and wherein sulfopolyester resin particles are aggregated together with colorant particles, which colorant particles can be optionally stabilized by submicron sulfonated polyester particles, and which processes involve high shearing conditions followed by heating for coalescence, and wherein during the heating no surfactants are utilized. Heating the mixture about above or in embodiments equal to the resin Tg generates toner particles with, for example, a volume average diameter of from about 0.5 to about 25 and preferably 1 to 10 microns as measured by known means, such as a Coulter Counter. It is believed that during the heating stage, the resin and colorant particles aggregate and coalesce together in one single step to form the composite toner particle. Furthermore, the aggregation and coalescence is such that a continuous growth in particle size is observed when heated at, for example, the optimum aggregation temperature, the optimum temperature being in the range of, for example, from about 40° C. to about 60° C. and preferably in the range of about 45° C. to about 55° C., and which heating can be accomplished in the presence of a coagulating agent of an organic amine. Also, with the present invention there is enabled a continuous process and the continuous growth of submicron polyester particles from the about 20 to 30 nanometers range to toner sized particles of from about 3 to about 20 microns in volume average diameter as determined by known methods, such as a Coulter Counter, and which processes can select controlled increases in the ionic strength of the mixture selected.

There can be selected for the imaging processes of the present invention a toner generated from the direct preparation of black and colored toner compositions with, for example, excellent colorant, such as pigment dispersion, and wherein the colorant dispersion is comprised of submicron, for example less than about 1 micron, in diameter particles and stabilized by submicron sulfonated polyester particles, and wherein there results toners with narrow GSD, and wherein the coagulant is a small organic molecule, such as Dytek or a similar suitable amine; in situ surfactant free processes for black and colored toner compositions by an emulsion aggregation process, and wherein a sulfonated polyester is selected as the resin and dissipated in water resulting in submicron polyester particles, reference the sulfonated polyesters of copending patent application U.S. Ser. No. 221,595, the disclosure of which is totally incorporated herein by reference; and the preparation of a toner with sulfonated polyester, which is easily dissipatible in water resulting in submicron particles to which the pigments, such as red, green, blue, yellow, and the like, and more specifically, HELIOGEN BLUE™ or HOSTAPERM PINK™ wet cakes, are introduced, and wherein the mixture resulting is further ground down by either attrition or other mechanical dispersion methods, such as an ultimizer, or a microfluidizer, resulting in a fine dispersion of pigment stabilized by submicron sulfonated polyester particles. Additionally, the submicron sulfonated resin particles used to stabilize the pigment particles can possess the same molecular weight, similar glass transaction and the same, or similar number of sulfonation groups properties as that of the submicron latex resin, and wherein the toner resulting possesses an average particle volume diameter of from between about 1 to about 20 microns, preferably from about 1 to about 10 microns, and more preferably about 2 to about 9 microns in volume average diameter, and with a narrow GSD of from, for example, about 1.12 to about 1.35, and preferably from about 1.14 to about 1.26 as measured by a Coulter Counter.

The toner compositions selected possess, for example, effective particle sizes by controlling the temperature of the aggregation, and which processes comprise stirring and heating about below the resin glass transition temperature (Tg), wherein a continuous growth in particle size is observed at a certain temperature, and wherein this temperature is, for example, from about 45° C. to about 60° C. or from about 2° C. to about 8° C. below the latex resin Tg; in high yields of from about 90 percent to about 100 percent by weight of toner without resorting to classification, and wherein surfactants are avoided; and wherein there is accomplished the dissipating of a polar charged sodium sulfonated polyester resin in water with a homogenizer at about 40° C. to about 90° C. resulting in submicron polyester particles in the size range of from about 50 to about 150 nanometers to form an emulsion latex, followed by aggregation coalescence of the submicron emulsion particles, and submicron pigment particles which are stabilized by the submicron sulfonated polyester particles, and wherein the aggregation is accomplished with an organic small molecule, such as Dytek, as a coagulant, and wherein the aggregation/coalescence is conducted at a temperature of about 2 to about 8 degrees below the resin Tg; and wherein the toner particle growth is terminated by quenching, or cooling the reactor contents; wherein there is prepared a linear dissipatible sulfonated polyester resin by a polycondensation process, wherein the synthesized resin is easily dispersed in warm water at temperatures of about 5 degrees above the resin Tg resulting in submicron particles in the diameter size range of from about 30 to about 250 nanometers, and preferably in the range of from about 50 to about 200 nanometers, and with a solids concentration of from about 5 to about 50 and preferably about 15 to about 30 weight percent of the aqueous phase, and wherein the solids are comprised of sulfonated resin particles, and thereafter adding colorant in the form of a wet cake and then further grinding down by mechanical means, such as by attrition, microfluidization or ultimization, resulting in colorant particles stabilized by submicron sulfonated polyester particles.

More specifically, the toner selected can be prepared by initially attaining or generating a colorant dispersion, for example, by dispersing an aqueous mixture of a colorant, such as a pigment or pigments, such as carbon black like REGAL 330® obtained from Cabot Corporation, phthalocyanine, quinacridone or RHODAMINE B™, and generally cyan, magenta, yellow, or mixtures thereof, and the like to enable aggregation/coalescence of submicron resin and resin stabilized pigment particles, and to generate toner size particles in the size range of from about 1 to about 20, more specifically from about 3 to about 10 microns and preferably in the range of from about 4 to about 9 microns, and with a narrow particle size distribution, which is in the range of, for example, from about 1.15 to about 1.25, and which aggregation is accomplished, for example, about 2° C. to about 5° C. below the Tg of the sulfonated resin; or by a process wherein there is prepared a colorant, especially pigment dispersion, such as HELIOGEN BLUE™, in which the pigment, preferably submicron in size, for example from about 0.05 to about 0.2 micron, is stabilized by submicron sulfonated polyester particles, which particles are in the size range of from about 50 to about 150 nanometers, in volume average diameter as preferably measured on the Nicomp particle sizer, and wherein a sulfonated polyester resin is slowly added, for example, over a period of about 30 minutes into hot water, which water is at a temperature of, for example, about 70° C. to 75° C., followed by stirring until the resin is fully dispersed resulting in submicron particles suitable for use as a colorant like pigment, or dye stabilizer. Shearing this dispersion with a latex of suspended sulfonated polyester resin particles preferably in the size range of from about 50 to about 300 nanometers enables the formation of aggregates. Thereafter, the mixture resulting is aggregated with an amine, such as an aliphatic amine, resulting in aggregates comprised of the resin and colorant particles. The speed at which the toner size aggregates are formed is primarily controlled by the temperature and by the amount of small organic molecules, such as Dytek selected, resulting in toner size particles in the range of from about 1 to about 20 microns and preferably in the range of from about 2 to about 10 microns, with a GSD of about 1.1 to about 1.4 and preferably about 1.14 to about 1.26.

In embodiments the toner process comprises preparing an emulsion latex comprised of water or a suitable equivalent and a polyester like sodio sulfonated polyester resin particles of, for example, submicrons, for example, less than about, or equal to about 0.1 micron in size diameter, and for example, from about 5 to about 500 nanometers, and in an amount of from about 1 to about 5 weight percent, by heating this resin in water at a temperature of, for example, from about 45° C. to about 90° C.; adding a colorant like pigment dispersion comprised of colorant stabilized by submicron sulfonated polyester particles to the latex mixture comprised of water and sulfonated polyester resin particles, followed by the coagulant addition of an amine, and wherein the coagulant is selected in an amount of, for example, from about 0.5 to about 5 and preferably from about 1 to about 3 weight percent in water until a slight increase in viscosity of, for example, from about 2 centipoise to about 100 centipoise is observed; heating the resulting mixture below about the resin Tg, and more specifically, at a temperature of, for example, from about 45° C. to about 60° C. thereby causing aggregation and coalescence, and resulting in toner particles of from about 4 to about 9 microns in size with a geometric distribution of less than about 1.25, and optionally quenching the product mixture to, for example, about 25° C., followed by filtering to remove any salts that may have formed and drying, and wherein the toner compositions are generated by preparing an emulsion latex comprised of sodio sulfonated polyester resin particles of from about 5 to about 500 nanometers in size diameter by heating the resin in water at a temperature of from about 65° C. to about 90° C.; adding a pigment dispersion, which pigment dispersion comprises submicron pigment particles in the size range of about 0.05 to about 0.6 micron (volume average diameter throughout), and preferably in the size range of about 0.06 to about 0.4 micron, stabilized by submicron sulfonated polyester particles in the size range of about 30 to about 350 nanometers and preferably in the size range of about 50 to about 300 nanometers to a latex mixture comprised of sulfonated polyester resin particles in water and with shearing, followed by the addition of the amine, such as Dytek, in water until a slight increase in the viscosity of from about 2 centipoise to about 100 centipoise is observed as measured by a Brookfield viscosity meter; heating the resulting mixture at a temperature of from about 45° C. to about 60° C. thereby enabling aggregation and coalescence simultaneously, resulting in toner particles of from about 4 to about 15 microns in volume average diameter and with a geometric distribution of less than about 1.25; and optionally quenching, or cooling the product mixture to about 25° C., followed by filtering and drying; and a surfactant free process comprising preparing an emulsion latex comprised of sodio sulfonated polyester resin particles of less than about 0.1 micron in size by heating the resin in water at a temperature of from about 15° C. to about 30° C. above its glass transition temperature; adding a pigment dispersion wherein the pigment dispersion comprises submicron pigment particles stabilized by submicron, for example from about 30 to about 120 nanometers in diameter, sulfonated polyester particles to a latex mixture comprised of sulfonated polyester resin particles in water, and subsequently adding an amine in an amount of from about 1 to about 10, or more specifically, from about 1 to about 3 weight percent in water until gellation results as indicated by, for example, an increase in viscosity of from about 2 centipoise to about 100 centipoise; heating the resulting mixture below about the resin Tg at a temperature of from about 45° C. to about 60° C. thereby enabling aggregation and coalescence, and quenching the product mixture with water to about 25° C., followed by filtering and drying; and a process for the preparation of toner compositions comprising preparing an emulsion latex comprised of sodio sulfonated polyester resin particles by heating the particles in water; adding a pigment dispersion comprised of pigment admixed with and stabilized by submicron sulfonated polyester resin particles to the latex mixture, followed by the addition of an amine; and heating the resulting mixture thereby enabling simultaneous aggregation and coalescence, and wherein no surfactants are utilized at any stage of the toner synthesis, thereby rendering the process completely surfactant free.

Moreover, in a further embodiment of the present invention the use of the submicron polyester resin particles as a colorant stabilizer results in the colorant particles being tightly bound to the resin particles thereby providing stability, and when such dispersions are selected for the toner synthesis substantially no colorant bleeding in the aqueous phase results as is often observed with surfactant stabilized colorants, such as RED 81.3 RHODAMINE™ pigment.

Examples of the toner polyester resin are as illustrated herein and in the patents and applications recited herein, and more specifically, examples of such polyesters include (i) a polyester of poly(1,2-propylene-sodio 5-sulfoisophthalate), poly(neopentylene-sodio 5-sulfoisophthalate), poly (diethylene-sodio 5-sulfoisophthalate), copoly(1,2-propylene-sodio 5-sulfoisophthalate)-copoly-(1,2-propylene-terephthalate phthalate), copoly(1,2-propylene-diethylene sodio 5-sulfoisophthalate)-copoly-(1,2-propylene-diethylene-terephthalate-phthalate), copoly (ethylene-neopentylene-sodio 5-sulfoisophthalate)-copoly-(ethylene-neopentylene-terephthalate-phthalate), or copoly (propoxylated bisphenol A)-copoly-(propoxylated bisphenol A-sodio 5-sulfoisophthalate; a process wherein the resin of (i) is a polyester of poly(1,2-propylene-sodio 5-sulfoisophthalate), poly(neopentylene-sodio 5-sulfoisophthalate), poly(diethylene-sodio 5-sulfoisophthalate), copoly(1,2-propylene-sodio 5-sulfoisophthalate)-copoly-(1,2-propylene-terephthalatephthalate), copoly(1,2-propylene-diethylene sodio 5-sulfoisophthalate)-copoly-(1,2-propylene-diethylene-terephthalate-phthalate), copoly(ethylene-neopentylene-sodio 5-sulfoisophthalate)-copoly-(ethylene-neopentylene-terephthalate-phthalate), or copoly (propoxylated bisphenol A)-copoly-(propoxylated bisphenol A-sodio 5-sulfoisophthalate; a process wherein the colorant is carbon black, cyan, yellow, magenta, and optionally wherein the toner particles isolated are from about 2 to about 15 microns in volume average diameter, and the geometric size distribution thereof is from about 1.15 to about 1.35; a process wherein there is added to the surface of the formed toner metal salts, metal salts of fatty acids, silicas, metal oxides, or mixtures thereof, each in an amount of from about 0.1 to about 10 weight percent of the obtained toner particles; a process wherein the toner obtained after cooling is from about 3 to about 15 microns in volume average diameter, and the geometric size distribution thereof is from about 1.15 to about 1.30.

The latex resin can be a sulfonated polyester, specific examples of which include those as illustrated in the patent and copending applications mentioned herein, such as U.S. Ser. No. 221,595, the disclosure of which is totally incorporated herein by reference, such as a sodio sulfonated polyesters, and more specifically, a polyester, such as poly (1,2-propylene-sodio 5-sulfoisophthalate), poly (neopentylene-sodio 5-sulfoisophthalate), poly(diethylene-sodio 5-suffoisophthalate), copoly(1,2-propylene-sodio 5-sulfoisophthalate)-copoly-(1,2-propylene-terephthalate phthalate), copoly(1,2-propylene-diethylene-sodio 5-sulfoisophthalate)-copoly-(1,2-propylenediethylene-terephthalate-phthalat), copoly(ethylene-neopentylene-sodio 5-sulfoisophthalate)-copoly-(ethylene-neopentylene-terephthalate-phthalate), copoly(propoxylated bisphenol A)-copoly-(propoxylated bisphenol A-sodio 5-sulfoisophthalate) bisphenylene, bis(alkyloxy) bisphenolene, and the like. The sulfopolyester possesses, for example, a number average molecular weight ($M_n$) of from about 1,500 to about 50,000 grams per mole, a weight average molecular weight ($M_w$) of, for example, from about 6,000 grams per mole to about 150,000 grams per mole as measured by gel permeation chromatography and using polystyrene as standards.

Various known suitable colorants, such as pigments, present in the toner in an effective amount of, for example, from about 1 to about 25 percent by weight of the toner, and preferably in an amount of from about 2 to about 12 weight percent, include carbon black like REGAL 330®; magnetites, such as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104™; and the like. As colored pigments, there can be selected cyan, magenta, yellow, red, green, brown, blue or mixtures thereof. Specific examples of pigments include phthalocyanine HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E.I. DuPont de Nemours & Company, and the like. Generally, colorants that can be selected are black, cyan, magenta, or yellow, and mixtures thereof. Examples of magentas are 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyans include copper tetra(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like; while illustrative examples of yellows are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™, and cyan components may also be selected as pigments with the process of the present invention. Other known colorants can be selected, reference the appropriate pigments, and dyes of the Color Index.

Colorant includes dyes, pigments, mixtures thereof, mixtures of pigments, mixtures of dyes, and the like.

Examples of charge acceptance additives that may be present in the liquid developers as optional components in various effective amounts of, for example, from about 0.001 to about 10, and preferably from about 0.01 to about 7 weight percent or parts, include cyclodextrins, aluminum di-tertiary-butyl salicylate; hydroxy bis[3,5-tertiary butyl salicylic] aluminate; hydroxy bis[3,5-tertiary butyl salicylic] aluminate mono-, di-, tri- or tetrahydrates; hydroxy bis [salicylic] aluminate; hydroxy bis[monoalkyl salicylic] aluminate; hydroxy bis[dialkyl salicylic] aluminate; hydroxy bis[trialkyl salicylic] aluminate; hydroxy bis[tetraalkyl salicylic] aluminate; hydroxy bis[hydroxy naphthoic acid] aluminate; hydroxy bis[monoalkylated hydroxy naphthoic acid] aluminate; bis[dialkylated hydroxy naphthoic acid] aluminate wherein alkyl preferably contains 1 to about 6 carbon atoms; bis[trialkylated hydroxy naphthoic acid] aluminate wherein alkyl preferably contains 1 to about 6 carbon atoms; bis[tetraalkylated hydroxy naphthoic acid] aluminate wherein alkyl preferably contains 1 to about 6 carbon atoms. Generally, the charge acceptor can be considered a nonpolar liquid insoluble or slightly soluble organic aluminum complex, or mixtures thereof Formulas II and which additives may be selected in admixtures with those components of the following Formulas I

I.

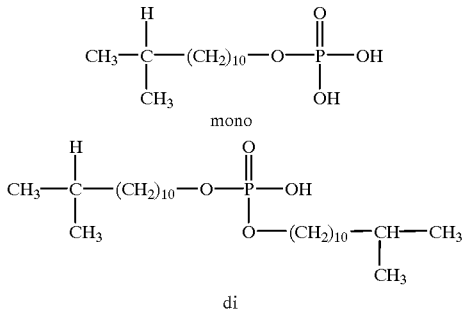

II.

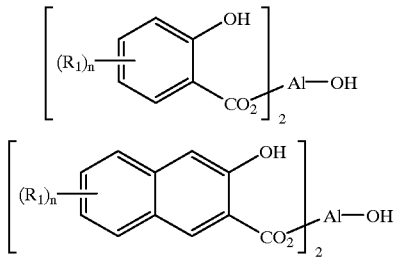

wherein $R_1$, is selected from the group consisting of hydrogen and alkyl, and n represents a number, such as from about 1 to about 4, reference for example U.S. Pat. No. 5,672,456, the disclosure of which is totally incorporated herein by reference.

Examples of liquid, especially nonpolar carriers or components selected for dispersing the polyester resin and colorant include a liquid with an effective viscosity of, for example, from about 0.5 to about 500 centipoise, and preferably from about 1 to about 20 centipoise, and a resistivity equal to or greater than, for example, $5\times10^9$ ohm/cm, such as $5\times10^{13}$. Preferably, the liquid selected is a branched chain aliphatic hydrocarbon. A nonpolar liquid of the ISOPAR® series (manufactured by the Exxon Corporation) may also be used for the developers of the present invention. These hydrocarbon liquids are considered narrow portions of isoparaffinic hydrocarbon fractions with extremely high levels of purity. For example, the boiling range of ISOPAR G® is between about 157° C. and about 176° C.; ISOPAR H® is between about 176° C. and about 191° C.; ISOPAR K® is between about 177° C. and about 197° C.; ISOPAR L® is between about 188° C. and about 206° C.; ISOPAR M® is between about 207° C. and about 254° C.; and ISOPAR V® is between about 254.4° C. and about 329.4° C. ISOPAR L® has a mid-boiling point of approximately 194° C. ISOPAR M® has an auto ignition temperature of 338° C. ISOPAR G® has a flash point of 40° C. as determined by the tag closed cup method; ISOPAR H® has a flash point of 53° C. as determined by the ASTM D-56 method; ISOPAR L® has a flash point of 61° C. as determined by the ASTM D-56 method; and ISOPAR M® has a flash point of 80° C. as determined by the ASTM D-56 method. The liquids selected are generally known and should have an electrical volume resistivity in excess of $10^9$ ohm-centimeters and a dielectric constant below 3.0 in embodiments of the present invention. Moreover, the vapor pressure at 25° C. should be less than 10 Torr in embodiments.

While the ISOPAR® series liquids can be the preferred nonpolar liquids for use as dispersant in the liquid developers of the present invention, the essential characteristics of viscosity and resistivity may be satisfied with other suitable liquids. Specifically, the NORPAR® series available from Exxon Corporation, the SOLTROL® series available from the Phillips Petroleum Company, and the SHELLSOL® series available from the Shell Oil Company can be selected.

The amount of the liquid employed in the developer of the present invention is, for example, from about 80 to about 99 percent, and preferably from about 85 to about 95 percent by weight of the total liquid developer. The term dispersion is used to refer to the complete process of incorporating toner particles into a liquid medium such that the final product consists of fine toner particles distributed throughout the medium. Since liquid developer consists of fine particles dispersed in a nonpolar liquid, it is often referred to as dispersion.

As illustrated herein, the developers or inks of the present invention can be selected for RCP imaging and printing methods wherein, for example, there can be selected an imaging apparatus, wherein an electrostatic latent image including image and nonimage areas is formed in a layer of marking material, and further wherein the latent image can be developed by selectively separating portions of the latent image bearing layer of the marking material such that the image areas reside on a first surface and the nonimage areas reside on a second surface. In a simple embodiment, the image development apparatus comprises a system for generating a first electrostatic latent image on an imaging member, wherein the electrostatic latent image includes image and nonimage areas having distinguishable charge potentials, and a system for generating a second electrostatic latent image on a layer of marking materials situated adjacent the first electrostatic latent image on the imaging member, wherein the second electrostatic latent image includes image and nonimage areas having distinguishable charge potentials of a polarity opposite to the charge potentials of the charged image and nonimage areas in the first electrostatic latent image.

Embodiments of the invention will be illustrated in the following nonlimiting Examples, it being understood that these Examples are intended to be illustrative only, and that the invention is not intended to be limited to the materials, conditions, process parameters and the like recited.

PREPARATION OF SULFONATED POLYESTER

Preparation of Linear Low Sulfonated Polyester GS722:

A linear sulfonated random copolyester resin comprised of, on a mol percent, 0.465 of terephthalate, 0.035 of sodium sulfoisophthalate, 0.475 of 1,2-propanediol, and 0.025 of diethylene glycol was prepared as follows. In a 5 gallon Parr reactor equipped with a bottom drain valve, double turbine agitator, and distillation receiver with a cold water condenser were charged 3.98 kilograms of dimethylterephthalate, 451 grams of sodium dimethyl sulfoisophthalate, 3.104 kilograms of 1,2-propanediol (1 mole excess of glycols), 351 grams of diethylene glycol (1 mole excess of glycols), and 8 grams of butyltin hydroxide oxide as the catalyst. The reactor was then heated to 165° C. with stirring for 3 hours whereby 1.33 kilograms of distillate were collected in the distillation receiver, and which distillate was comprised of about 98 percent by volume of methanol and 2 percent by volume of 1,2-propanediol as measured by the ABBE refractometer available from American Optical Corporation. The mixture was then heated to 190° C. over a one hour period, after which the pressure was slowly reduced from atmospheric pressure to about 260 Torr over a one hour period, and then reduced to 5 Torr over a two hour period with the collection of approximately 470 grams of distillate in the distillation receiver, and which distillate was comprised of approximately 97 percent by volume of 1,2-propanediol and 3 percent by volume of methanol as measured by the ABBE refractometer. The pressure was then further reduced to about 1 Torr over a 30 minute period whereby an additional 530 grams of 1,2-propanediol were collected. The reactor was then purged with nitrogen to atmospheric pressure, and the polymer product discharged through the bottom drain onto a container cooled with dry ice to yield 5.60 kilograms of 3.5 mol percent sulfonated polyester resin, copoly(1,2-propylene-diethylene) terephthalate-copoly(sodium sulfoisophthalate dicarboxylate). The sulfonated polyester resin glass transition temperature was measured to be 56.6° C. (onset) utilizing the 910 Differential Scanning Calorimeter available from E.I. DuPont operating at a heating rate of 10° C. per minute. The number average molecular weight was measured to be 3,250 grams per mole, and the weight average molecular weight was measured to be 5,290 grams per mole using tetrahydrofuran as the solvent.

Preparation of Latex Stock Solutions:

1,000 Grams of deionized water were heated to 65° C. (Centigrade throughout), after which 250 grams of the above prepared sulfonated polyester (GS722) were slowly introduced and heated for 1 hour at 65° C., until the polyester polymer was fully dispersed. The latex had a characteristic blue tinge and was found to have a particle size of 35 nanometers (volume weighted) as measured using a Nicomp particle sizer. These solutions were found to be stable with substantially no settling of particles.

Preparation of Moderately Sulfonated Polyester Resin for Pigmented Dispersions (CN25):

A linear sulfonated random copolyester resin comprised of, on a mol percent, 0.425 of terephthalate, 0.075 of sodium sulfoisophthalate, 0.45 of 1,2-propanediol, and 0.025 of diethylene glycol was prepared as follows. In a 5 gallon Parr reactor equipped with a bottom drain valve, double turbine agitator, and distillation receiver with a cold water condenser were charged 3.50 kilograms of dimethylterephthalate, 940 grams of sodium dimethyl sulfoisophthalate, 2.90 kilograms of 1,2-propanediol (1 mole excess of glycols), 449 grams of diethylene glycol (1 mole excess of glycols), and 7.2 grams of butyltin hydroxide oxide as the catalyst. The reactor was then heated to 165° C. with stirring for 3 hours, whereby 1.15 kilograms of distillate were collected in the distillation receiver, and which distillate was comprised of about 98 percent by volume of methanol and 2 percent by volume of 1,2-propanediol as measured by the ABBE refractometer available from American Optical Corporation. The mixture was then heated to 190° C. over a one hour period, after which the pressure was slowly reduced from atmospheric pressure to about 260 Torr over a one hour period, and then reduced to 5 Torr over a two hour period with the collection of approximately 320 grams of distillate in the distillation receiver, and which distillate was comprised of approximately 97 percent by volume of 1,2-propanediol and 3 percent by volume of methanol as measured by the ABBE refractometer. The pressure was then further reduced to about 1 Torr over a 30 minute period whereby an additional 60 grams of 1,2-propanediol were collected. The reactor was then purged with nitrogen to atmospheric pressure, and the polymer product discharged through the bottom drain onto a container cooled with dry ice to yield 6.1 kilograms of 7.5 mol percent sulfonated polyester resin, copoly(1,2-propylene-diethylene) terephthalate-copoly(sodium sulfoisophthalate dicarboxylate). The sulfonated polyester resin glass transition temperature was measured to be 57° C. (onset) utilizing the 910 Differential Scanning Calorimeter available from E.I. DuPont operating at a heating rate of 10° C. per minute. The number average molecular weight was measured to be 2,780 grams per mole, and the weight average molecular weight was measured to be 4,270 grams per mole, as measured on a Waters GPC using tetrahydrofuran as the solvent.

Preparation of the Submicron Polyester Dispersion:

One liter (1,000 milliliters) of the distilled water was first heated up to 700° C. (10° C. to 15° C. above the resin Tg), to which 200 grams of the above sulfonated polyester (CN25) were slowly introduced while stirring until completely dispersed. The mean particle size as measured using a Nicomp particle size analyzer was found to be 20 nanometers, with a size range of 5 to 30 nanometers. The solids loading was 20 weight percent polyester in water.

General Colorant Dispersion Synthesis:

To the above dispersion containing 20 weight percent of the submicron sulfonated resin dispersion was added a colorant, like a cyan wet cake of pigment containing 50 weight percent solids, and the mixture resulting was subjected to grinding to enable a stable colorant dispersion with an average submicron particle size of between 50 to 120 nanometers. There resulted a dispersion with 30 weight percent colorant, 10 weight percent submicron polyester resin particles, and 60 weight percent water. Similarly, a Yellow 180, Red 122, Red 238, Red 81.3 and carbon black REGAL 330® dispersions stabilized by polyester resin particles were prepared by Sun Chemicals, and these dispersions were then utilized in the toner synthesis.

EXAMPLE I

Toner Synthesis Cyan 15.3:

50 Grams of sulfonated polyester resin GS722 were hydrodispersed in 200 grams of hot (55° C. to 65° C.) water. The particle size of the latex at this point was 35 nanometers (Nicomp Volume-Weighted Average). To this emulsion were added 5.85 grams of a cyan pigment dispersion wherein the pigment was stabilized by the submicron sulfonated polyester resin particles, and which pigment dispersion was comprised of 30 percent pigment, believed to be physically coated on the resin, 10 percent sulfonated polyester, and 60 percent water. This mixture was polytroned and 2.5 grams of the amine Dytek, which is 2-methyl-1,5-pentanediamine, in 5 milliliters of water were added. This emulsion was then transferred into a 1 liter reaction kettle equipped with an overhead stirrer. The resulting mixture was heated with stirring to 52° C. After 4.5 hours, there resulted toner particles comprised of 96.25 weight percent of the sulfonated polyester resin and 3.75 weight percent of pigment, and which toner possessed a particle size of 6.7 microns in volume average diameter, and with a GSD of 1.18 as determined by a Coulter Counter. The resulting mixture was diluted with 2 liters of cold water and filtered. The filtrate was clear with no evidence of free pigment in the water phase, and water was further removed to obtain EA (emulsion/aggregated toner) particles in the dry state.

EXAMPLE II

Toner Synthesis Containing Red 81.3 (Magenta):

50 Grams of sulfonated polyester resin GS722 were hydrodispersed in 200 grams of hot (55° C. to 65° C.) water. The particle size of the latex at this point was 35 nanometers (Nicomp Volume Weighted Average). To this emulsion were added 8.3 grams of a magenta pigment dispersion wherein the pigment was stabilized by the submicron sulfonated polyester resin particles (as described above), and which dispersion was comprised of 30 percent pigment, Pigment Red 81.3, 10 percent sulfonated polyester and 60 percent water. This mixture was polytroned and 2.5 grams of Dytek (2-methyl-1,5-pentanediamine throughout) in 5 milliliters of water were added. This emulsion was then transferred into a 1 liter reaction kettle equipped with an overhead stirrer. The resulting mixture was heated with stirring to 52° C. After 4.5 hours, there resulted toner particles comprised of 95 weight percent of the sulfonated polyester resin and which toner possessed a GSD of 1.20. The mixture was diluted with 2 liters of cold water and filtered to remove any salts that may have been formed in the process. The filtrate was clear with no evidence of free pigment in the water phase and no evidence of free pigment in the water phase, and water was further removed to obtain EA particles in the dry state.

EXAMPLE III

Toner Synthesis Containing Red 122 (Magenta):

50 Grams of sulfonated polyester resin GS722 were hydrodispersed in 200 grams of hot (55° C. to 65° C.) water. The particle size of the latex at this point was 35 nanometers (Nicomp Volume Weighted Average). To this emulsion were added 8.3 grams of a magenta pigment dispersion wherein the pigment was stabilized by the submicron sulfonated polyester resin particles (as described above), and which dispersion was comprised of 30 percent pigment, Pigment 122, 10 percent sulfonated polyester and 60 percent water. This mixture was polytroned and 2.5 grams of Dytek in 5 milliliters of water were added. The resulting emulsion was transferred into a 1 liter reaction kettle equipped with an overhead stirrer. The mixture was then heated with stirring to 52° C. After 4.5 hours, the particles comprising 95 weight percent of the sulfonated polyester resin and 5 weight percent of pigment were of a size of 6.2 microns with a GSD of 1.18. The mixture was then diluted with 1 liter of cold water and filtered to remove any salts that may have been formed in the process. The filtrate was clear with no evidence of free pigment in the water phase, and water was further removed to obtain EA particles in the dry state.

EXAMPLE IV

Toner Synthesis Containing Red 238 ( Magenta):

50 Grams of sulfonated polyester resin GS722 was hydrodispersed in 200 grams of hot (55 to 65° C.) water. The particle size of the latex at this point was 35 nanometers (Nicomp Volume Weighted Average). To this emulsion were added 8.3 grams of a magenta pigment dispersion wherein the pigment was stabilized by the submicron sulfonated polyester resin particles (as described above), and which dispersion was comprised of 30 percent pigment, Pigment 238, 10 percent sulfonated polyester and 60 percent water. This mixture was polytroned and 2.5 grams of Dytek in 5 milliliters of water were added. The resulting emulsion was transferred into a 1 liter reaction kettle equipped with an overhead stirrer. The mixture was then heated with stirring to 54° C. After 4.5 hours, the particles were comprised of 95 weight percent of the sulfonated polyester resin and 5 weight percent of pigment, and which toner possessed a size of 6.7 microns and a GSD of 1.17. The mixture was then diluted with 1 liter of cold water and filtered to remove any salts that may have been formed in the process. The filtrate was clear with no evidence of free pigment in the water phase, and water was further removed to obtain EA particles in the dry state.

EXAMPLE V

Toner Synthesis Containing Red 122/238 (Magenta):

50 Grams of sulfonated polyester resin GS722 was hydrodispersed in 200 grams of hot (55° C. to 65° C.) water. The particle size of the latex at this point was 35 nanometers (Nicomp Volume Weighted Average). To this emulsion were added 8.3 grams of a magenta pigment dispersion containing a mixture of 4.98 grams of Red 122 and 3.32 grams of Red 238 dispersion, wherein the pigment for both dispersions was stabilized by the submicron sulfonated polyester resin particles (as described above), and which dispersions were comprised of 30 percent pigment, 10 percent sulfonated polyester and 60 percent water. This mixture was polytroned and 2.5 grams of Dytek in 5 milliliters of water were added. The resulting emulsion was transferred into a 1 liter reaction kettle equipped with an overhead stirrer. The mixture was then heated with stirring to 54° C. After 4.5 hours, there resulted particles comprised of 95 weight percent of the sulfonated polyester resin and 5.0 weight percent of pigment, and which toner had a size of 7 microns and a GSD of 1.17. The resulting mixture was diluted with 1 liter of cold water and filtered to remove any salts that may have been formed in the process. The filtrate was clear with no evidence of free pigment in the water phase, and water was further removed to obtain EA particles in the dry state.

EXAMPLE VI

Toner Synthesis Containing REGAL 330® (Black):

50 Grams of sulfonated polyester resin GS722 were hydrodispersed in 200 grams of hot (55° C. to 65° C.) water. The particle size of the latex at this point was 35 nanometers (Nicomp Volume Weighted Average). To this emulsion were added 10 grams of a black pigment dispersion wherein the pigment was stabilized by the submicron sulfonated polyester resin particles (as described above), and which dispersion was comprised of 30 percent of the pigment, carbon black REGAL 330®, 10 percent sulfonated polyester and 60 percent water. This mixture was polytroned and 2.5 grams of Dytek in 5 milliliters of water were added. The resulting emulsion was transferred into a 1 liter reaction kettle equipped with an overhead stirrer. The mixture was then heated with stirring to 54° C. After 4.5 hours, the particles comprising 94 weight percent copoly(1,2-propylene-diethylene-sodio 5-sulfoisophthalate)-copoly-(1,2-propylene-diethylene-terephthalate-phthalate) sulfonated polyester resin and 6 weight percent of pigment possessed a size of 6.8 microns with a GSD of 1.18. The mixture was diluted with 1 liter of cold water and filtered to remove any salts that may have been formed in the process. The filtrate was clear with no evidence of free pigment in the water phase, and water was further removed to obtain EA particles in the dry state.

EXAMPLE VII

Toner Synthesis Containing Yellow 180:

50 Grams of sulfonated polyester resin GS722 were hydrodispersed in 200 grams of hot (55° C. to 65° C.) water. The particle size of the latex at this point was 35 nanometers (Nicomp Volume Weighted Average). To this emulsion were added 13.5 grams of a black pigment dispersion wherein the pigment was stabilized by the submicron sulfonated polyester (copoly-(1,2-propylene-diethylene-sodio 5-sulfoisophthalate)-copoly-(1,2-propylene-diethylene-terephthalate-phthalate—throughout) resin particles (as described above, and which dispersion was comprised of 30 percent pigment, pigment Yellow 180, 10 percent sulfonated polyester and 60 percent water). This mixture was polytroned and 2.5 grams of Dytek in 5 milliliters of water were added. The resulting emulsion was transferred into a 1 liter reaction kettle equipped with an overhead stirrer. The mixture was then heated with stirring to 52° C. After 4.5 hours, the particles comprising 92 weight percent of sulfonated polyester resin, and 8 weight percent of the above pigment were of a size of 6.75 microns and had a GSD of 1.18. The mixture was diluted with 1 liter of cold water and filtered to remove any salts that may have been formed in the process. The filtrate was clear with no evidence of free pigment in the water phase, and water was further removed to obtain EA particles in the dry state.

CHARGING VOLTAGE TEST

Charging Voltage Test For Embodiments Usinq EA-based Liquid Developers:

An experimental setup for accomplishing a charging test is illustrated in the appropriate copending application, such as U.S. Ser. No. 09/492,707 recited herein. A thin (5 to 25 micrometers) liquid toner layer 5 is prepared on a flat conductive plate 6. The plate is grounded through a meter 7. The charging wire of the scorotron is represented by 1, the scorotron grid by 3, ions by 4, ground by 8, and electrostatic voltmeter by 10 with DC representing direct current. A charging device, such as a scorotron 2, is placed above the plate. The device can be used, measured the charging current passing through the toner layer or the charging voltage of the toner layer. For a charging voltage test, a meter 7 is not required. A thin (5 to 25 micrometers) liquid toner layer is prepared on a flat conductive plate. A scorotron is placed above the sample plate. When the scorotron is turned off, the charged toner layer on the plate is instantly moved to an immediately adjacent location underneath the electrostatic voltmeter (ESV) in order to measure the surface voltage. The ESV 10 is located about 1 to about 2 millimeters above the charged toner layer. A typical test involves first charging the toner layer with a scorotron for 0.5 second, and then monitoring the surface voltage decay as a function of time for two minutes. This is accomplished for both positively and negatively charged toner layers.

EXAMPLE VIII

Liquid Developer Containing 10 Percent Polyester EA Toner Solids:

Example II was repeated with the exception that the resulting dry powder sulfonated polyester EA toner (GS826) contains 24 percent Pigment Red 81:3 magenta pigment and 76 percent polyester resin 2 microns in volume average diameter and with a GSD of 1.24. Twenty grams of GS826 polyester EA toner and one hundred eighty grams of ISOPAR® M were added to a glass jar containing steel shots of 3/16" in diameter. The mixture in the glass jar was ball milled for four hours. The resulting liquid developer contains about 10 percent toner solids and about 90 percent ISOPAR® M.

The polyester EA liquid developer in ISOPAR® M, prepared according to the above, was then coated on a conductive substrate by draw bar coating method as described in the charging voltage test. The resulting liquid developer layer comprised of both polyester EA toner solids and liquid with a thickness varying from ~10 to 30 microns, depending on the size of the draw bar used for coating. The liquid developer layer contains about 10 percent polyester EA toner solids. Scorotrons were used as charging and recharging devices. The scorotron grid voltage and current were 250 volts and 250 microamperes, respectively. The scorotron was turned on for 0.5 second, followed by fast moving the charged liquid developer layer under an ESV for charging voltage measurements as a function of time.

The net positive and negative charge polarities of the liquid developer layer were determined by the positive and negative scorotron grid polarities, respectively. When positive 250 volts of the scorotron grid voltage were applied, the resulting surface voltage was +114 volts for a liquid developer layer of 25.7 micron thickness. The surface voltage was measured at 2 seconds after the scorotron was turned off. This liquid developer layer contained about 0.21 mg/square centimeter of toner solids. When negative 250 volts of the scorotron grid voltage was applied, the resulting surface voltage was −86 volts for the same liquid developer layer as the above.

Other embodiments and modifications of the present invention may occur to those skilled in the art subsequent to a review of the information presented herein; these embodiments and modifications, as well as equivalents thereof, are also included within the scope of this invention.

What is claimed is:

1. A reverse charging printing liquid developer comprised of a nonpolar liquid, and dispersed therein a dry toner comprised of a sulfonated polyester resin and a colorant.

2. A liquid developer comprised of a nonpolar liquid, and dispersed therein a dry toner comprised of a sulfonated polyester resin and a colorant, and wherein said toner is generated by emulsion/aggregation/coalescence processes, and wherein said developer further contains a charge acceptance additive.

3. A liquid developer in accordance with claim 1 wherein said liquid has a viscosity of from about 0.5 to about 500 centipoise and a resistivity equal to or greater than about $5\times10^9$, and said resin possesses a volume average particle diameter of from about 0.1 to about 30 microns.

4. A liquid developer in accordance with claim 1 wherein the colorant is present in an amount of from about 0.1 to about 60 percent by weight based on the total weight of the toner components of resin and colorant.

5. A liquid developer in accordance with claim 1 wherein the colorant is carbon black, cyan, magenta, yellow, blue, green, orange, red, violet and brown or mixtures thereof.

6. A liquid developer in accordance with claim 1 wherein said liquid is present in an amount of from about 75 to about 97 weight percent, said sulfonated polyester is present in an amount of about 40 to about 100 weight percent resin and from about zero (0) to about 60 weight percent of colorant is present.

7. A liquid developer in accordance with claim 1 wherein the liquid for said developer is an aliphatic hydrocarbon.

8. A liquid developer in accordance with claim 7 wherein the aliphatic hydrocarbon is a mixture of branched hydrocarbons of from about 8 to about 16 carbon atoms, or a mixture of normal hydrocarbons of from about 8 to about 16 carbon atoms.

9. A liquid developer in accordance with claim 7 wherein the aliphatic hydrocarbon is a mixture of branched hydrocarbons with from about 8 to about 16 carbon atoms.

10. A liquid developer in accordance with claim 1 wherein said sulfonated polyester resin is prepared by heating said resin in water at a temperature of from about 65° C. to about 90° C.; (i) thereafter adding said colorant as a dispersion, wherein the colorant dispersion is stabilized by said sulfonated polyester, and wherein said sulfonated polyester is of a submicron diameter or size, followed by the addition of an amine and water until there results an increase in the latex viscosity of from about 2 centipoise to about 100 centipoise, cooling, and heating the resulting mixture at a temperature of from about 45° C. to about 80° C. thereby enabling continuous aggregation and coalescence of particles of resin and colorant, resulting in toner particles of from about 2 to about 20 microns in volume average diameter.

11. A liquid developer in accordance with claim 10 wherein the colorant dispersion contains a pigment, and wherein the pigment is stabilized by said submicron sulfonated polyester, and which polyester is a sodio sulfonated polyester, and which resin is in the size range of from about 50 to about 250 nanometers, and wherein shearing is accomplished (i) by homogenizing at from about 1,000 revolutions per minute to about 10,000 revolutions per minute, at a temperature of from about 25° C. to about 35° C., and for a duration of from about 1 minute to about 120 minutes.

12. A liquid developer in accordance with claim 10 wherein the dispersion of (i) is accomplished by microfluidization in a microfluidizer, or in nanojet for a duration of from about 1 minute to about 120 minutes.

13. A liquid developer in accordance with claim 11 wherein shearing or homogenization is accomplished by homogenizing at from about 1,000 revolutions per minute to about 10,000 revolutions per minute for a duration of from about 1 minute to about 120 minutes.

14. A liquid developer in accordance with claim 1 wherein the sulfonated polyester is a polyester of poly(1,2-propylene-sodio 5-sulfoisophthalate), poly(neopentylene-sodio 5-sulfoisophthalate), poly(diethylene-sodio 5-sulfoisophthalate), copoly(1,2-propylene-sodio 5-sulfoisophthalate)-copoly-(1,2-propylene-terephthalate-phthalate), copoly(1,2-propylene-diethylene sodio 5-sulfoisophthalate)-copoly-(1,2-propylene-diethylene-terephthalate-phthalate), copoly(ethylene-neopentylene-sodio 5-sulfoisophthalate)-copoly-(ethylene-neopentylene-terephthalate-phthalate), or copoly(propoxylated bisphenol A)-copoly-(propoxylated bisphenol A-sodio 5-sulfoisophthalate).

15. A liquid developer in accordance with claim 2 wherein the polyester is poly(1,2-propylene-sodio 5-sulfoisophthalate), poly(neopentylene-sodio 5-sulfoisophthalate), poly(diethylene-sodio 5-sulfoisophthalate), copoly(1,2-propylene-sodio 5-sulfoisophthalate)-copoly-(1,2-propylene-terephthalate-phthalate), copoly(1,2-propylene-diethylene sodio 5-sulfoisophthalate)-copoly-(1,2-propylene-diethylene-terephthalate-phthalate), copoly(ethylene-neopentylene-sodio 5-sulfoisophthalate)-copoly-(ethylene-neopentylene-terephthalate-phthalate), or copoly(propoxylated bisphenol A)-copoly-(propoxylated bisphenol A-sodio 5-sulfoisophthalate).

16. A liquid developer in accordance with claim 1 wherein the polyester utilized is from about 0.01 to about 0.2 micron in volume average diameter, and the colorant particles are from about 0.01 to about 500 nanometers in volume average diameter; and wherein the toner particles isolated are from about 2 to about 15 microns in volume average diameter, and the geometric size distribution thereof is from about 1.15 to about 1.35.

17. A liquid developer in accordance with claim 10 wherein the toner obtained after cooling is from about 3 to about 15 microns in volume average diameter, and the geometric size distribution thereof is from about 1.15 to about 1.30.

18. A process for the preparation of the liquid developer of claim 1 comprising mixing an emulsion latex comprised of sulfonated polyester resin particles and a colorant dispersion, and wherein the colorant is stabilized by said resin particles, followed by the addition of an amine; and heating the resulting mixture thereby causing aggregation and coalescence.

19. A process in accordance with claim 18 wherein subsequent to heating to accomplish coalescence the product mixture is cooled, followed by isolation, washing and drying.

20. A process in accordance with claim 19 wherein the product mixture is cooled to about 25° C.

21. A reverse charge printing process utilizing the liquid developer of claim 1.

22. A process in accordance with claim 21 wherein the developer is charged by bipolar ion charging.

23. An imaging or printing apparatus containing the developer of claim 1.

24. A reverse charging printing liquid developer consisting essentially of a nonpolar liquid, and dispersed therein a dry toner comprised of a sulfonated polyester resin and a colorant.

25. A liquid developer consisting essentially of a nonpolar liquid, and dispersed therein a dry toner comprised of a sulfonated polyester resin and a colorant, and wherein said toner is generated by emulsion/aggregation/coalescence processes, and wherein said developer further contains a charge acceptance additive.

26. A liquid developer in accordance with claim 2 wherein said charge acceptance additive is a cyclodextrin or an aluminum complex.

* * * * *